US008531493B2

(12) United States Patent
Hui

(10) Patent No.: US 8,531,493 B2
(45) Date of Patent: Sep. 10, 2013

(54) DYNAMIC BIT SEQUENCE SELECTION

(75) Inventor: Sue Hui, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1611 days.

(21) Appl. No.: 11/617,714

(22) Filed: Dec. 28, 2006

(65) Prior Publication Data

US 2008/0158268 A1 Jul. 3, 2008

(51) Int. Cl.
*G09F 9/37* (2006.01)

(52) U.S. Cl.
USPC ..... 345/691; 345/108

(58) Field of Classification Search
None
See application file for complete search history.

(56) References Cited

U.S. PATENT DOCUMENTS 6,201,521 B1 3/2001 Doherty
6,226,054 B1 5/2001 Morgan et al.
6,778,155 B2 8/2004 Doherty et al.
6,970,150 B2 11/2005 Hewlett et al.
2006/0238485 A1* 10/2006 Yang ..... 345/102

* cited by examiner

*Primary Examiner* — Joseph Haley
(74) *Attorney, Agent, or Firm* — Warren L. Franz; Wade J. Brady, III; Frederick J. Telecky, Jr.

(57) ABSTRACT

Disclosed embodiments comprise dynamic pulse width modulation (PWM) bit sequence selection techniques for use with video display devices. By dynamically selecting and applying a bit sequence based on the display image content and the limited dynamic range of human perception, the bit sequence used to display a given scene may be optimized in order to provide for increased bit depth or increased brightness. Generally one out of a plurality of available bit sequences would be applied to a given scene, with different bit sequences designated for displaying bright scenes and dark scenes. Alternatively, different bit sequences may be applied depending upon the amount of motion in a scene. Thus, a dynamic bit sequence selection technique may allow for a display device with increased bit depth and increased brightness.

23 Claims, 4 Drawing Sheets

DYNAMIC BIT SEQUENCE SELECTION

FIELD OF THE INVENTION

Disclosed embodiments relate generally to display systems, and more specifically to display systems utilizing pulse width modulation (PWM) bit sequences to create intermediate light intensity levels.

BACKGROUND OF THE INVENTION

The image quality of video display systems is constantly increasing. Modern video display systems are capable of creating images having a very large number of intermediate gray-scale light intensity levels. Digital display systems, such as digital micromirror devices (DMD) and some plasma and liquid crystal displays, use pulse width modulation (PWM) to create the appearance of intermediate gray-scale intensity levels even though the display device is actually only capable of creating pixels at full intensity. In other words, PWM allows for the recreation of a wide array of gray-scale intensity levels, even though the actual pixels of the display device are only capable of creating either full light or full darkness levels at a particular time.

A digital micromirror device (DMD), for example, is made up of an array of thousands or even millions of bistable mirror elements, interacting with a light source and a projection surface. Each of the mirror elements of the DMD may switch between two positions, corresponding to an open or closed light configuration, based on the angle at which the mirror tilts towards the light source. A micromirror is in an open position when it is oriented to reflect the light source onto the projection surface. A micromirror is in a closed position when it is oriented so that none of the light provided by the light source is projected onto the projection surface. Thus, each micromirror can be oriented in either an open or "on" position, or a closed or "off" position.

By rapidly turning a particular micromirror "on" and "off", the appropriate intermediate gray-scale intensity level (shade of light) can be projected for a particular pixel on the projection surface. So a "white" pixel may be produced by having the micromirror remain in the open position for the duration of the frame, a "black" pixel may be produced by having the micromirror remain in the closed position for the duration of the frame, and intermediate shades of gray may be produced by switching the micromirror between the open and closed positions over the course of the frame. The gray-scale shade level of the pixel for a given frame would be proportional to the amount of time that the micromirror was "on," with the gray-scale shade being darker if the "on" time is less than the "off" time, and the gray-scale shade being lighter if the "on" time is greater than the "off" time for a given frame. Color hues may also be added to a DMD projection system by, for example, time multiplexing the white light source through a color wheel and coordinating the switching of each micromirror with respect to the color wheel in order to blend colors to create the desired hue.

In practice, the micromirrors alternate between open and closed positions so fast that the human eye cannot discern the discrete "on" and "off" positions of each micromirror. Instead, the human eye extrapolates the discrete binary images projected by each mirror element into a wide variety of pixel shades and hues, integrating the pulses of light in a way that produces a perceived flicker-free brightness level. In this way, DMDs allow for the accurate reproduction of a whole array of shades and hues by taking advantage of the human eye's averaging of quickly varying brightnesses and colors.

Generally each micromirror is controlled by a memory cell, typically underlying the micromirror. The pattern of switching a micromirror "on" and "off" to create a particular shade of gray (or hue of color) for a pixel is determined by loading a PWM bit sequence into each memory cell. Creating a very large number of gray-scale intensity levels using a pulse width modulation based system requires short bits; the bit depth of the display device (and thus the number of shades and hues discretely reproducible) depends on the length of the display time period for the least significant bits. As a result, PWM display systems with a high degree of intensity resolution (bit depth) may have some bit display time periods that are shorter than the time required to reload the pixel memory cells. Thus, the physical limitations of the display system (such as the load time and the mirror settling time) may act as a limitation to the available bit depth.

In a DMD, the memory cell under each mirror is generally addressed in a binary fashion according to a PWM sequence, controlling the switching of the micromirror "on" and "off." For every video frame, each bit-plane of data would first be loaded into the memory cells of the DMD, one bit-plane at a time, and then the bit-plane data in the memory cells under the mirrors would generally be globally applied to all associated mirrors at the same time. This global application of data to all mirrors at the same time is called a "global-reset" operation. As a general rule, a DMD functioning in a global-reset mode loads all memory cells with the entire bit-plane of data before any data may be globally applied to the mirrors.

Using the basic pulse width modulation scheme described above to create intermediate gray-scale intensity levels can introduce image artifacts, however. These sorts of PWM artifacts are recognized in the art and are most visible when there is motion in the image or motion of the viewer's eye and when the image includes adjacent image pixels having intensity levels near, and on either side of, the threshold of the most significant intensity bit.

A number of techniques have been developed to mitigate such PWM artifacts. One technique provides for splitting the duration of the larger bits into multiple, smaller segments and distributing the segments throughout the refresh period. Larger bits, such as the most significant bit, would generally be split into segments that are no smaller than the least significant bit. Using such a bitsplitting technique can create a more pleasing image with less artifacts, serving as an improvement over the more basic PWM sequence (which would leave the mirror in one position for the whole bit period). Problems may arise, however, if the LSB or any bit split segments become too short. If a bit segment display time period is shorter than the load time of the device, then there would not be enough time to load the entire array of memory cells (using a global reset) while quickly turning the short bits "off." This would act as a physical limitation on the bit depth that the display device might have, limiting the number of intermediate gray-scale intensity levels available for the display device.

A phased reset technique has been developed to attempt to minimize this limitation, allowing shorter display time periods and thus increasing bit depth. Rather than globally applying a bit plane of data to all memory cells (and their associated mirrors) at the same time using a global-reset, a phased reset would load, reset, and display bit plane data in reset groups. Dividing bit planes into reset groups would reduce the amount of data to be loaded at any one time (since only a portion of the bit plane would be loaded into a specific reset group at a time). The accompanying reduction in the load time (for the reset group rather than the entire mirror array) would allow display of smaller bits (with shorter display time periods); unlike global-reset, only the time to load one reset group would limit the display time of the short bit-plane. This phased reset technique, using reset groups, is described in detail in U.S. Pat. No. 6,201,521. While the phased reset technique allows smaller bits and increased bit depth, ultimately the minimum display time period would still be limited by the device's load time for the reset blocks. So again, the load time would serve to physically limit the bit depth of the display device (and if smaller short bits are necessary for image display, then clearing techniques with associated "deadtime" may be required).

Several techniques (for displaying short bits) have been developed to attempt to overcome this limitation on bit depth imposed by the load time (in order to provide shorter display times, allowing a greater number of intermediate gray-scale intensity levels). One example involves the use of "global clear bits." A global clear function can be performed in a fraction of the load time (for either the entire, global device, or a reset block). In the case of bit-planes representing LSBs with short "on" times, data would be successfully applied to the mirrors and displayed. Then the mirrors would be reset to the "off" state using a global clear function, prior to a new bit-plane being completely loaded into the memory cells of the DMD. This technique may allow for short bits with bit display times less than the load time. The clearing of the entire memory would be needed in order to allow micromirrors to be turned off quickly enough to generate the desired short "on" times (with the micromirrors switching to the "off" position before the next bit-plane has been fully loaded and is ready to be applied). By using a global clear part way through the LSB period, all of the micromirrors of the entire array would be quickly turned off, where they would remain for one split-bit period while the next normal bit-plane (or reset group) finishes loading into the memory cells. The mirrors cannot be turned back on until the DMD is loaded with a new bit-plane (or reset block) of data, resulting in "deadtime" (or an increase in the amount of displayed dark time when the mirrors are in the "off" position) after displaying any LSB bit-planes with display time periods ("on" times) less than the load time (of either the bit plane, if applied globally, or the reset block). The cumulative effect of the "deadtime" that occurs when all of the micromirrors are turned "off" early would be to significantly decrease the display device's brightness.

Similarly, "fast clear bits" may be used to display short bits. A fast clearing technique would insert a fast clear bit within block data loads during a frame refresh period. A short bit would be loaded, but rather than being reset in the normal fashion (which would not be fast enough to display a short bit with a bit display time period less than the load time), the fast clear function would be applied to terminate the short bit at the appropriate time (to provide the short bit display time period). Again, using this technique means that the mirrors would all be turned off (dark) until the next normal load occurs, resulting in "deadtime" and significantly decreasing the brightness of the display device.

So to date, there are several different types of bits that may be used in pulse width modulation. Standard bits are globally applied across all mirrors at the same time using a global-reset operation. Phased reset bits are applied to reset groups, reducing the load time and thereby increasing the bit depth of the device (without resulting in "deadtime"). Clear bits utilize clearing functions to provide for short bits with display time periods less than the load time of either the entire bit-plane or a reset group of the device. So clear bits may be used to increase the available bit depth (by overcoming load time limitations), but this increase in bit depth tends to reduce the brightness of the display device.

Global clear bits and fast clear bits are merely examples of the types of PWM techniques developed to increase bit depth (at the cost of brightness, due to the introduction of "deadtime"). Such short bit techniques may allow for the reproduction of a larger number of intermediate gray-scale light intensity levels. And the shorter bits they enable may help reduce PWM artifacts, especially when used in conjunction with bitsplitting.

Unfortunately, the loss of brightness stemming from the use of various PWM bit sequence techniques designed to allow for increased bit depth may reduce the effectiveness of the overall display device. Thus there is a need for a technique that will allow for increased peak brightness while also allowing for short bit display times, where the memory load (and mirror settling) times exceed the split-bit or LSB display time. Additional details regarding pulse width modulation in general and some of the specific techniques developed to allow for shorter bits (and display time periods less than the load time) may be found in U.S. Pat. Nos. 6,970,150; 6,778,155; and 6,226,054.

SUMMARY OF THE INVENTION

There is a need for a PWM bit sequencing technique that will provide increased bit depth (allowing short bits with bit display time periods less than the load time of the entire mirror array and/or reset blocks when needed to provide adequate detail for image discrimination) without greatly reducing the overall brightness of the display device. Disclosed embodiments address this need by dynamically selecting between a plurality of PWM bit sequences depending upon the display image content or other image characteristics. In doing so, disclosed embodiments seek to take advantage of the inherently limited nature of human perception, using the limited dynamic range of the human eye to allow for dynamic optimization of the bit sequence.

When viewing bright scenes, the human eye cannot distinguish between small differences in light intensity. The human eye loses the ability to discriminate between small variances of light intensity when faced with significant background light levels (scene brightness levels above a certain threshold value). In these instances, there may be less of a need for PWM bit sequences with short bits, since the level of intensity detail discernable to the human eye is sufficiently low that short bit display intensity levels (when the bit display time period is less than the device's load time) would be unobservable. In such bright scenes, the human eye will not generally notice if a short bit remains "on" a little too long. Any extra brightness intensity would basically be lost against the backdrop of the overall brightness of the scene. Thus, the limited dynamic range of the human eye in perceiving brightness allows for the effective use of bit sequences without fast clears or global clears (or any type of bit with deadtime) for bright scenes.

When viewing dark scenes, however, the human eye is better able to discriminate between smaller differences in light intensity. Essentially, the contrast between the overall darkness of the scene and the illuminated pixels may allow the human eye to discriminate between smaller differences in light intensity level. In such dark scenes, the human eye generally will notice if a short bit remains "on" a little too long, since the extra brightness would flare out against the backdrop of the overall darkness of the scene. So in these instances, there may be more of a need for short bits (allowing for increased bit depth and intensity resolution). By using a bit sequence that maximizes the number of short bits (utilizing fast or global clearing, for example, so that short bits with display time periods less than the device's load time may be shown), improved bit depth and PWM performance (minimizing PWM artifacts) may be achieved when displaying dark scenes.

Taking advantage of the naturally limited dynamic range of the human eye, disclosed embodiments may select from a plurality of bit sequences, choosing the appropriate bit sequence for displaying a particular frame of a scene depending upon the display image content or other image characteristics of the scene. For example, a PWM bit sequence optimized for increasing bit depth (and possibly decreasing PWM artifacts) might be selected for dark scenes. So for example, a PWM bit sequence using either a global or a fast clearing technique might be used when rendering short bits in dark scenes. On the other hand, a bit sequence optimized for achieving maximum peak brightness might be selected for bright scenes. So, a bit sequence that does not employ either global or fast clearing techniques (or any type of bit with deadtime) when rendering short bits might be used for a bright scene.

Similarly, scenes with the sort of significant motion that might lead to PWM artifacts might be better displayed by maximizing short bits, while scenes without significant motion may not require bit sequences with associated "deadtime." Dynamically selecting the appropriate bit sequence for displaying a particular scene allows short bits to be available to provide increased bit depth when necessary, so that all of the image data discernable in a dark scene (or necessary to prevent PWM artifacts due to motion) may be accurately displayed, while the brightness of the device would be increased by using a bit sequence that does not create "deadtime" when displaying bright (and/or still) scenes. Disclosed embodiments might also use one or more intermediate bit sequences for scenes with brightness above the dark threshold but below the bright threshold, for example, with multiple intermediate bit sequences providing for smooth transitions.

The threshold values for selecting which bit sequence to use for displaying a particular scene might, for example, be determined based on the ability of the human eye to perceive differences in intensity levels and PWM artifacts against a particular background (scene) level of brightness. So, the appropriate bit sequence might be selected by analyzing scene brightness and comparing the brightness to the predetermined human perception thresholds. Alternatively, the appropriate bit sequence might be selected based on other factors, such as the amount of motion present in a given scene. Using this type of dynamic bit sequence selection technique may allow for optimization of the PWM bit sequence based on the observable display characteristics (such as scene brightness or motion), taking into account the practical range of discrimination of human perception. Dynamically selecting bit sequences provides for a flexible approach, allowing for selection among any of a number of it sequencing techniques, including bit sequencing techniques that include using reset blocks, global clears, or fast clears) in order to provide an optimized display having increased bit depth, increased brightness, and decreased PWM artifacts.

BRIEF DESCRIPTION OF THE DRAWINGS

Embodiments are illustrated by way of example in the accompanying figures, in which like reference numbers indicate similar elements, and in which.

DETAILED DESCRIPTION OF EMBODIMENTS

The disclosed embodiments comprise a dynamic bit sequence selection technique, generally choosing the appropriate bit sequence for a given scene based on the display characteristics of a scene. Typical display characteristics that might be used to select from a plurality of bit sequences would be scene brightness, motion characteristics of the scene, or some other suitable characteristic. By taking advantage of the inherent limitations of the human eye's dynamic range when discerning intensity levels against varying amounts of background (scene) light (or when discerning PWM artifacts based on scene motion), PWM bit sequences may be selected in a way that maximizes the benefits of a particular bit sequence while minimizing its drawbacks. For example, a bit sequence optimized for increased bit depth may be selected for dark scenes, since such a bit sequence would provide the degree of intensity resolution discernable to the human eye in dark scenes and since a loss of brightness in such scenes is generally perceived as less important than the ability to discriminate between small differences in intensity level. On the other hand, a bit sequence optimized for maximizing peak brightness might be selected for bright scenes, since this would provide for increased overall brightness for the display device and since, under these circumstances, the human eye generally would not be able to readily detect PWM artifacts and/or the small differences in intensity level created when the LSB bit display time period is limited by the device's load time.

As explained above, the device's load time (which may act as a limiting factor on the length of bit display available without associated "deadtime") may be that for the entire array (if global reset is being applied) or it may be that for a reset group. Regardless of the type of reset being used to apply the bit sequence to the display device, the device will have an associated, limiting load time. If the LSB is less than this load time, then "deadtime" (with an associated period of darkness) will result. Thus, a bit sequence optimized for maximizing peak brightness (by employing no short bits with associated deadtime) might be selected for bright scenes, since the human eye would not be able to detect the small intensity levels generated by short bits with associated "deadtime" against the background level of brightness. On the other hand, a bit sequence maximized for short bits (and thus having "deadtime" associated with the short bits generated using a clearing function) might be selected for dark scenes that require increased bit depth for adequate display. So by dynamically selecting bit sequences based on the display image content, adequate bit depth may be achieved without a significant loss of peak brightness.

Figure 1:
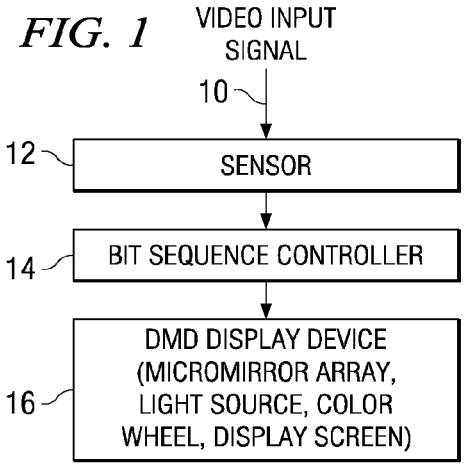
FIG. 1 is a block diagram of the elements of an exemplary device for implementing a dynamic bit sequence selection technique based on brightness.

FIG. 1 generally illustrates exemplary elements for use with a DMD display device utilizing a dynamic bit sequence selection technique based on brightness. The input video signal 10 is analyzed by the sensor 12 to determine the brightness or other characteristic of the scene. The controller 14 then compares the characteristic to one or more threshold values or a decision matrix to determine which bit sequence (from a plurality of PWM bit sequences) to apply. The selected bit sequence would then control the switching of the DMD micromirror elements in order to display the video image associated with the input video signal 10 on the display device 16. This process typically occurs in real-time, such that the input signal 10 is continuously analyzed to dynamically determine and apply the appropriate bit sequence for displaying each frame of the input video signal 10.

Figure 2:
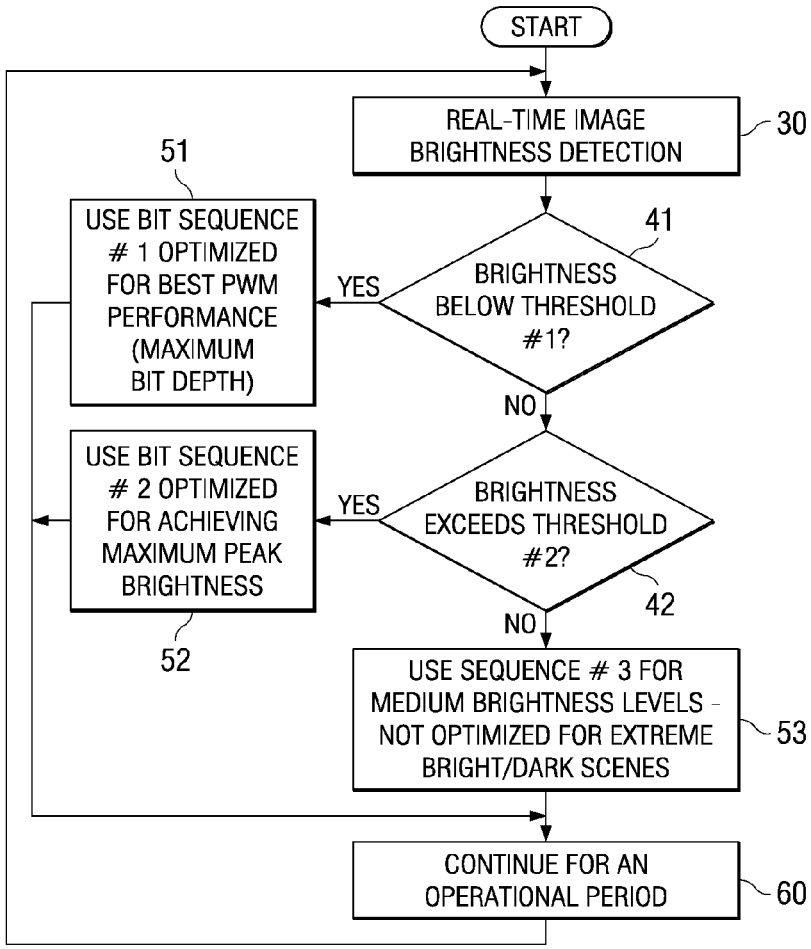
FIG. 2 is a flow chart diagram of an exemplary dynamic bit sequence selection technique.

FIG. 2 shows an exemplary embodiment of such a dynamic bit sequence selection technique in flow-chart format. With continued reference to FIG. 1, the illustrated activities would generally be implemented in computer hardware, software, or firmware operating in the bit sequence controller 14, operating in connection with or otherwise in communication with the sensor 12 and the display device 16. In this example, the input video signal 10 is initially analyzed or sensed for brightness or for another scene characteristic at block 30. Brightness is used throughout this disclosure as the sensed scene characteristic in the illustrated embodiments, but the illustrated techniques and systems can be employed for adaptation of bit sequences to adjust for other scene characteristics, such as scene motion or other scene characteristics.

Figure 3A:
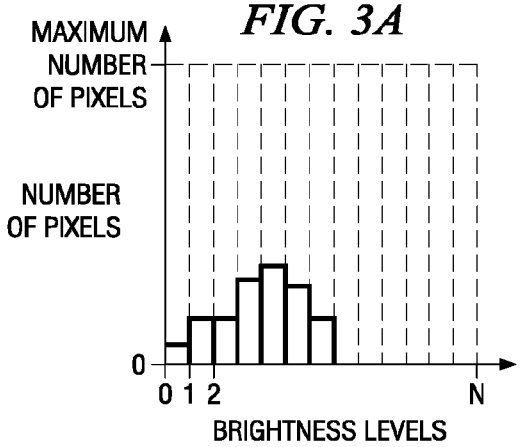
FIGS. 3A, 3B, and 3C illustrate histograms that may be used to determine scene brightness.
Figure 3B:
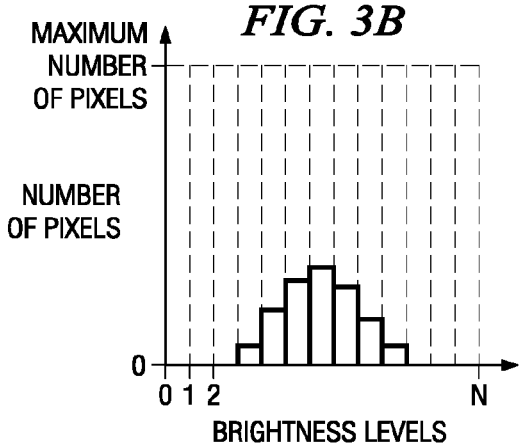
Figure 3C:
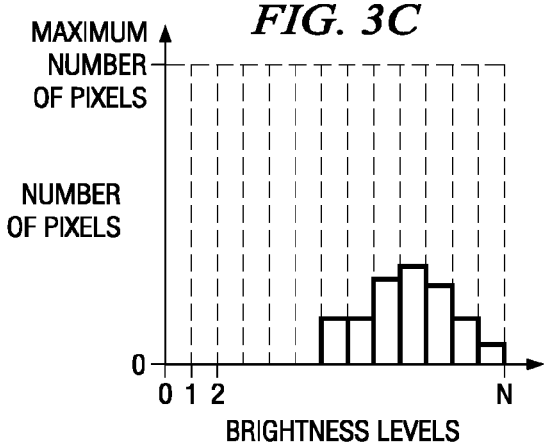

Generally, as shown in block 30, the disclosed embodiments may employ real-time image brightness detection to determine scene brightness. By way of example, the brightness of a scene may be determined by analyzing the total average power of the input video signal per frame. Such brightness determinations may be made based on the analysis of a single frame of video input, but typically an average would be applied across multiple frames. Scene brightness or scene characteristics may also be determined using a histogram technique. FIGS. 3A, 3B, and 3C illustrate such histograms in the context of brightness detection. The continuum of brightness levels (from zero representing total darkness to the maximum available brightness) would be divided into discrete brightness level intervals. For any given frame of an image, the number of pixels corresponding to each brightness level interval would be determined (as represented by the height of the bar in each column of the graphs). From this determination, the average brightness of the frame may be readily discerned. FIG. 3A, for example, illustrates a histogram representing a dark frame image, since most of the pixels have brightnesses located towards the lower end of the range of brightness levels. FIG. 3C, on the other hand, illustrates an exemplary representation of a bright frame image, since most of the pixels have a brightness located towards the upper end of the range of brightness levels. FIG. 3B illustrates an exemplary representation of an average brightness frame image, since most of the pixels have a brightness located near the middle of the range of brightness levels. Typically, scene brightness would be determined based on an average brightness level of histograms across multiple frames, in order to prevent sequence switching based on an isolated single frame of the image.

As illustrated in the flowchart of FIG. 2, once the brightness of a particular scene has been determined at block 30, that brightness would then be compared to one or more threshold values at blocks 41 and 42. The threshold values would determine if a scene is bright or dark, and would generally be set based on the limited dynamic range of the human eye in perceiving brightness. In other words, the threshold values would typically be based on the ability of the human eye to perceive differences in intensity levels and PWM artifacts against a particular background level of scene brightness. In FIG. 2, the detected brightness is first compared to the first threshold value (block 41), to determine if it is a dark scene. If the scene's brightness is below the first threshold value, then a first PWM bit sequence may be applied (block 51), where the first PWM bit sequence is optimized for increased bit depth and improved PWM performance (by minimizing PWM artifacts). By way of example, a PWM bit sequence using either global or fast clears to allow for short bits (whose bit display time period may be less than the load time of the device, resulting in "deadtime") might be selected for dark scenes with brightness below the first threshold value. The PWM bit sequence for dark scenes would generally be designed to maximize bit depth and minimize PWM artifacts. Thus, a bit sequence that maximizes the short bits (created using fast or global clears, for example) might be selected.

The first threshold value (employed at block 41) would generally be set based on a scene brightness level at which the human eye gains the ability to readily distinguish between pixel light intensity levels less than that produced when the bit display time period is equal to the load time (of either the entire array or a reset block, for example, depending on the technique used by the device). In other words, the first threshold value might be set at a scene brightness level at which the human eye can readily distinguish short bits with display time periods smaller than the load time. In addition, the brightness level at which PWM artifacts are readily apparent to the human eye may be factored into the determination of the first threshold.

This brightness level for the first threshold value would generally be determined by experimentation, studying actual human responses to scenes of varying background light level in order to select a threshold value for dark scenes. By basing the first threshold value on the human eye's ability to discern differing intensity levels for short bits with bit display times less than the load time in the context of a specific level of background light, a PWM bit sequence optimized for bit depth and PWM performance may be selected in those instances when it may serve to improve the image display quality.

On the other hand, if the detected scene brightness is above the first threshold value, then as shown in the embodiment of FIG. 1, it could be compared to a second threshold value (see block 42), to determine if it is above the second threshold. In the case of "brightness" as the measured scene characteristic, then this would indicate that the scene is a bright scene and that the bit sequence should be optimized accordingly. For example, the second PWM bit sequence may be applied at block 52 to achieve desirable performance in bright scenes. For example, the bit sequence might be selected to achieve maximum peak brightness. By way of example, a PWM bit sequence that does not use either global or fast clears (or any type of short bit with deadtime) might be selected for bright scenes with brightness above the second threshold value. The PWM bit sequence for bright scenes would generally be designed to maximize brightness by avoiding "deadtime."

Thus, a bit sequence that does not use fast or global clears or any other type of bit that might introduce "deadtime."

The second threshold value would generally be set based on a scene brightness level at which the human eye loses the ability to readily distinguish between pixel light intensity levels less than that produced when the bit display time period is equal to the load time. In other words, the second threshold value might be set at a scene brightness level at which the human eye can no longer readily distinguish short bits with display time periods smaller than the load time. This brightness level for the second threshold value would again generally be determined by experimentation, studying actual human responses to pixels of varying intensity within scenes of varying background light level in order to select a threshold value for bright scenes.

By basing the second threshold value on the human eye's inability to discern differing intensity levels for short bits with bit display times less than the load time in the context of a specific background level of light, a PWM bit sequence optimized for maximum peak brightness may be selected in those instances when the lack of short bits (with bit display times shorter than the load time) will likely have no practical effect on the perceived optical performance of the display device. In other words, the second threshold value allows for a reduced bit depth in those instances when the loss of intensity resolution will be generally undetectable by the human eye. The benefit of using such a second PWM bit sequence in those instances is that the peak brightness of the display device will be increased, since there will be none of the "deadtime" associated with short bits.

Still referring to FIG. 2, a third, intermediary PWM bit sequence (designed for medium brightness scenarios) may be applied at block 53 would be used in those instances when the scene brightness level is above the first threshold value but below the second threshold value. This would be a more normalized type of bit sequence, optimized neither for dim scenes nor bright scenes. This third bit sequence would thus generally be a compromise between the first bit sequence and the second bit sequence, and might for example use some clearing function to allow for some number of short bits with display times less than the load time of the display device, without maximizing the bit depth.

In all cases as described above, the process is designed to be continual and dynamic, updating the optimal bit-sequences in real-time as the scenes being displayed on the display device 16 change. Shown as the next operational stage therefore is block 60, which serves as a possible delay before again specifically testing the scene characteristic. There could be advantages in computation time and in image consistency if an applied bit sequence is allowed to remain for a certain operational period before being adjusted. For example, if bit sequences were changed too rapidly in certain embodiments this might detract from image quality, and accordingly this operational stage could be useful to slow the transitions. This operation stage may not be necessary, however, and in such embodiments the process of real-time image brightness detection (or other scene characteristic detection) can be instituted immediately after the sequence to be employed has been determined as described above.

With further reference to FIG. 1, once the appropriate PWM bit sequence has been selected for a scene, the bit sequence controller 14 would select the chosen PWM bit sequence to be used by the display system 16 to generate the frame of the display image from the input video signal 10. This process operates continuously, so that the images from the input video signal 10 are displayed on the display device 16 with dynamically adjusted bit sequence techniques. By using such a dynamic bit sequence selection technique, the bit depth and peak brightness of the display device may both be increased as needed based on the image characteristics of a particular scene.

Figure 4:
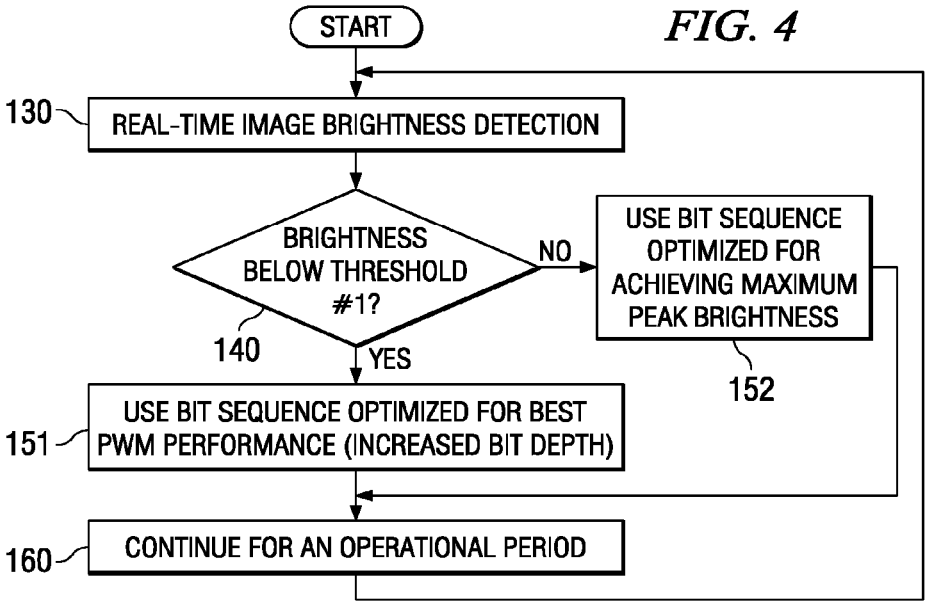
FIG. 4 is a flow chart diagram of an alternative exemplary dynamic bit sequence selection technique.

FIG. 4 shows another illustrative embodiment of a dynamic bit sequence selection technique in flow-chart format. In the present embodiment, the input video signal 10 is analyzed first to determine scene brightness as described previously with regard to FIG. 1. In this embodiment, however, the scene brightness is then compared to the single threshold value (at block 140). If the brightness is below the single threshold value, then a first PWM bit sequence, optimized for increased bit depth and improved PWM performance, would be selected and applied at block 151. If the brightness is above the single threshold value, then a second PWM bit sequence, optimized for brightness, would be selected and applied at block 152. The second PWM sequence might be optimized for achieving maximum peak brightness, or it might be designed to account for medium brightness levels.

The single threshold value of FIG. 4 would be set based on the limited dynamic range of the human eye. For example, it might be based on a scene brightness level at which the human eye gains the ability to discern varying intensity levels for short bits with bit display time periods less than the load time. Or it might be based on a brightness at which the human eye loses the ability to discern varying intensity levels for short bits with display time periods less than the load time. Such a threshold may be experimentally determined.

As was described above relative to the embodiment of the flow-chart of FIG. 2, this process operates continually so that the images from the input video signal are displayed on the display device. By using such a dynamic bit sequence selection technique, the bit depth and peak brightness of the display device may both be increased as needed based on the image characteristics of a particular scene. Depending non design considerations, a certain operational period 160 may be included to allow the selected bit sequence to consider for some period before the real-time image brightness detection or other scene characteristic sensor 12 is again examined.

It may also be useful to employ a whole range of available bit sequences in conjunction with a decision matrix (consisting of multiple decision parameters or thresholds) in order to provide for a smooth transition between techniques for displaying different brightness levels. In effect, the technique described in FIG. 2 could be expanded to include additional bit sequences selected based on additional threshold parameters. By way of example, bright scenes would be displayed using bit sequences without any short bits having associated "deadtime." Dark scenes would be displayed using bit sequences maximizing the number of bit segments. Stated another way, dark scenes would be displayed using the maximum number of short bits (using global or fast clears, for example) in order to maximize bit depth. A range of intermediate bit sequences might be used to display scenes between the two extremes. Thus, scenes near the upper brightness range might be displayed using reset blocks (to allow for increased bit depth without adding "deadtime." Scenes with brightness levels below those appropriate for display using reset blocks alone might be displayed using a range of bit sequences that include short bits having associated "deadtime." For example, more short bits could be used as the brightness level approaches that of a dark scene, at which time the maximum number of short bits (having associated "deadtime") would be used. Thus, the process may be fully dynamic, and the level of discrimination may be fine tuned by selecting the appropriate bit sequence for displaying a particular scene based on incremental changes in the brightness level, for example.

One exemplary technique that could be useful in this context would be to employ hysteresis. Hysteresis typically uses multiple, paired thresholds to reduce sequence switching based on incremental changes in brightness (and in particular, to prevent rapid switching back and forth between different sequences based on small changes in the detected brightness). So if the display sequence is switched from a first bit sequence (A) to a second bit sequence (B) because the brightness level exceeds a particular threshold, then hysteresis would prevent the sequence from switching back to the first sequence merely because the brightness falls below that initial threshold. Instead, a second hysteresis threshold, paired with the first, would be used to prevent sequence switching based on only an incremental change of brightness. Only if the brightness level fell below the second threshold would the sequence then switch back to the first bit sequence (A). The difference between the two paired thresholds would be the hysteresis value, representing the amount of protection built into the system to prevent too-frequent switching due to incremental changes in brightness.

Figure 5:
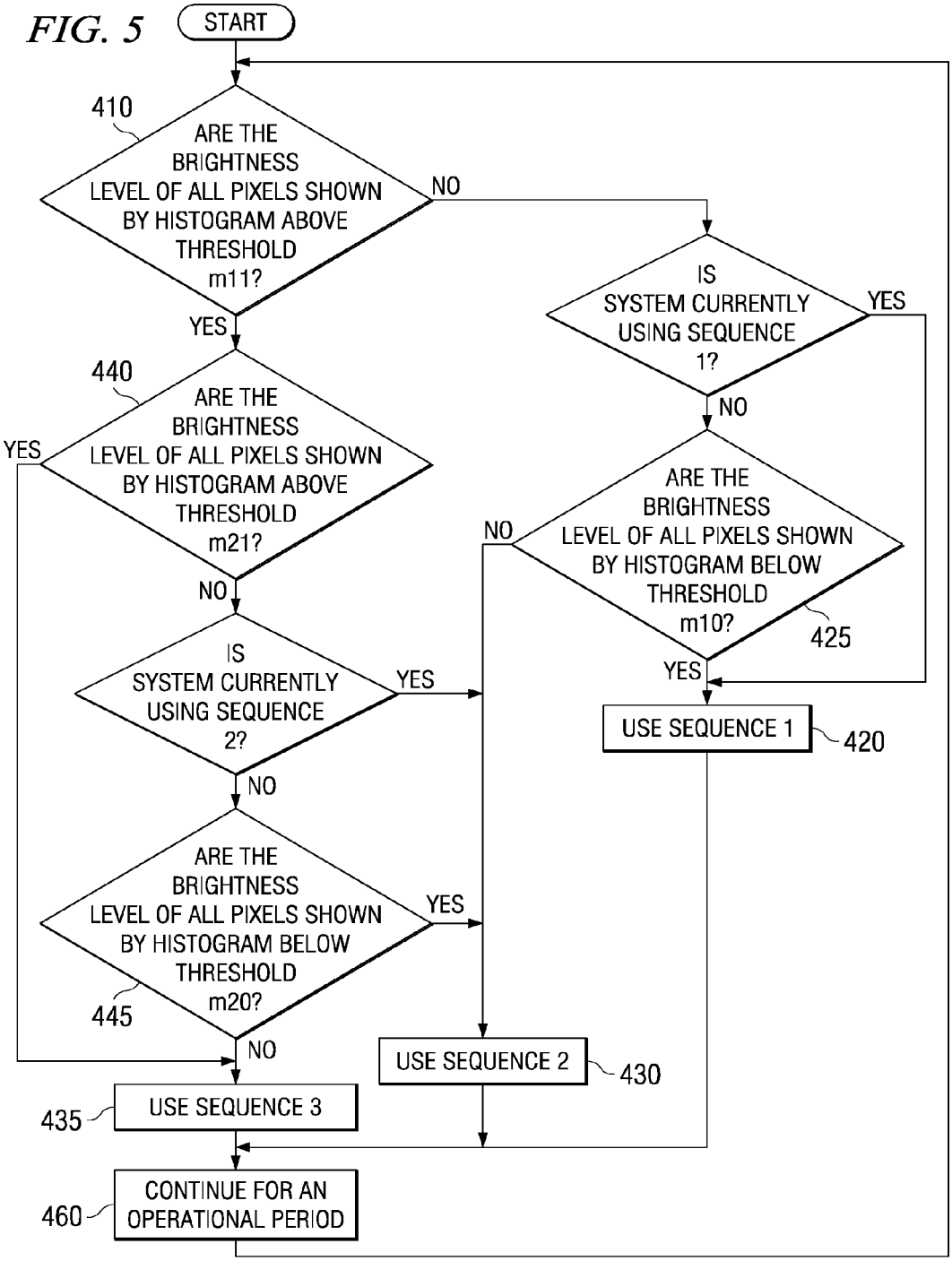
FIG. 5 is a flow chart diagram illustrating a sequence selection technique using a decision matrix with hysteresis based on scene brightness.
Figure 5A:
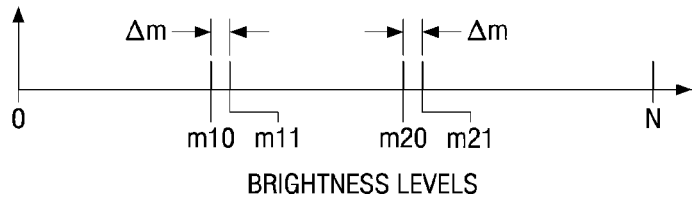
FIG. 5A is a chart illustrating exemplary hysteresis values for brightness thresholds.

FIG. 5, in conjunction with FIG. 5A, provides an illustrative example of such a hysteresis process, used with a decision matrix for selecting between three available bit sequences. As FIG. 5A shows, two standard thresholds (m11 and m21) would be used to select among three bit sequences, where 0<m11<m21<N (with N as the maximum brightness level). In general, below threshold m11, sequence 1 would be used to display the image; above threshold m21, sequence 3 would be used to display the image; and for brightnesses between thresholds m11 and m21, sequence 2 would be used to display the image. In the example of FIG. 5, sequence 1 would maximize bit depth, sequence 3 would maximize brightness, and sequence 2 would compromise between bit depth and brightness performance. These general rules may, however, be altered somewhat depending upon the hysteresis value of the system.

Each threshold value employs a hysteresis value of Δm. Thus, threshold m11 has an associated, paired threshold m10, which in the example of FIG. 5A is set at a brightness level Δm below that of the primary threshold m11. Likewise, threshold m21 has an associated, paired threshold m20, set at a brightness level Δm below that of the primary threshold m21. When such a hysteresis approach is used, the actual sequence used to display a particular scene depends not only on the detected brightness level in comparison to the two primary thresholds (m11 and m21), but also on the sequence currently being used and the detected brightness level in comparison to the paired hysteresis threshold. This may be clearly seen in the example of FIG. 5.

In FIG. 5, the brightness would be detected (typically based on an averaged histogram). If the brightness is below threshold m11 (block 410) and the system is currently using sequence 1, then the system continues to use sequence 1 (block 420). If the brightness is below threshold m11 (block 410) but the system is currently using sequence 2, then a second inquiry must take place to determine whether to continue using sequence 2 or to switch to sequence 1. This determination would be based on the hysteresis value. In this case, if the brightness level is below hysteresis threshold m10 (block 425), then the system would switch to sequence 1 (block 420). On the other hand, if the brightness level is above hysteresis threshold m10 (block 425), then the system would continue to use sequence 2 (block 430) to display the image.

If the brightness is above threshold m21 (block 440), then sequence 3 (block 435) would be used to display the image. However, if the brightness is above threshold m11 (block 410) but below threshold m21 (block 440), then additional inquiries would be needed to determine the appropriate sequence to use. In such an instance, if the system is currently using sequence 2, then it would continue to use sequence 2 (block 430). Otherwise, the determination would depend upon the hysteresis value. If the brightness is below the hysteresis threshold m20 (block 445), then the system would switch to sequence 2 (block 430). On the other hand, if the brightness is above hysteresis threshold m20 (but below threshold m21), then the system would continue to use sequence 3 (block 435) to display the image. FIG. 5 illustrates an exemplary decision matrix with hysteresis, but it should be understood that it is not intended to be limiting. For example, the hysteresis thresholds could be located Δm above the corresponding primary thresholds. More than three sequences could be used, with additional thresholds, and Δm could be set to any useful level of hysteresis. The example of FIG. 5 is merely intended to assist in illustrating the basic elements of hysteresis.

As discussed above with the other embodiments, an operational period 460 is illustrated to provide a resting point of sorts after a sequence has been determined before the scene is tested again for the characteristics being monitored. This operational period 460 may or may need be desired according to other system design considerations. If the operational period is not used, the process would repeat back to the starting determination at block 410 essentially after the sequence is determined and applied by the bit sequence controller 14 at block 420, 430, and 435.

Brightness is merely one image characteristic that may be used to select among a plurality of bit sequences. Any image characteristic (or some combination of image characteristics) that could affect the manner/quality of image display may be similarly used to select the appropriate sequence based on appropriate thresholds. By way of example, the amount of motion detected in a scene could be used to select among bit sequences, since motion often affects the PWM artifacts visible in a scene. Typically, the more motion present in a scene, the more likely there will be noticeable PWM artifacts detracting from the quality of the image. Thus, if the image has very little motion, a bit sequence optimized for brightness might be used. But if a scene has a lot of motion, then a bit sequence with increased bit depth (for example maximizing short bits by using clearing functions with associated "deadtime") might be used in order to reduce the PWM artifacts at the expense of scene brightness.

In effect, the process of selecting bit sequences based on motion operates similarly to that set forth above in detail for brightness. The amount of motion in a scene would first be detected, and this value would be compared to thresholds to determine which bit sequence to use when displaying a particular scene. The goal would be to use short bits with associated "deadtime" (to increase the bit depth) when necessary to reduce harmful PWM artifacts, and to use bit sequences maximized for brightness (with no short bits having deadtime) in instances when PWM artifacts would not be noticeable to the human eye. In this way, the overall brightness of the display device may be improved, without affecting the device's ability to effectively display content. The motion of a scene would typically be determined based on either the movement of special interest objects within the scene (such as a human face, arm, or any such area with smooth transitions of brightness levels of the same or similar colors) or the movement of the entire image. And typically, the most relevant movement for sequence selection purposes would be movement in the horizontal direction (although vertical movement could also be used as a decision factor).

Figure 6:
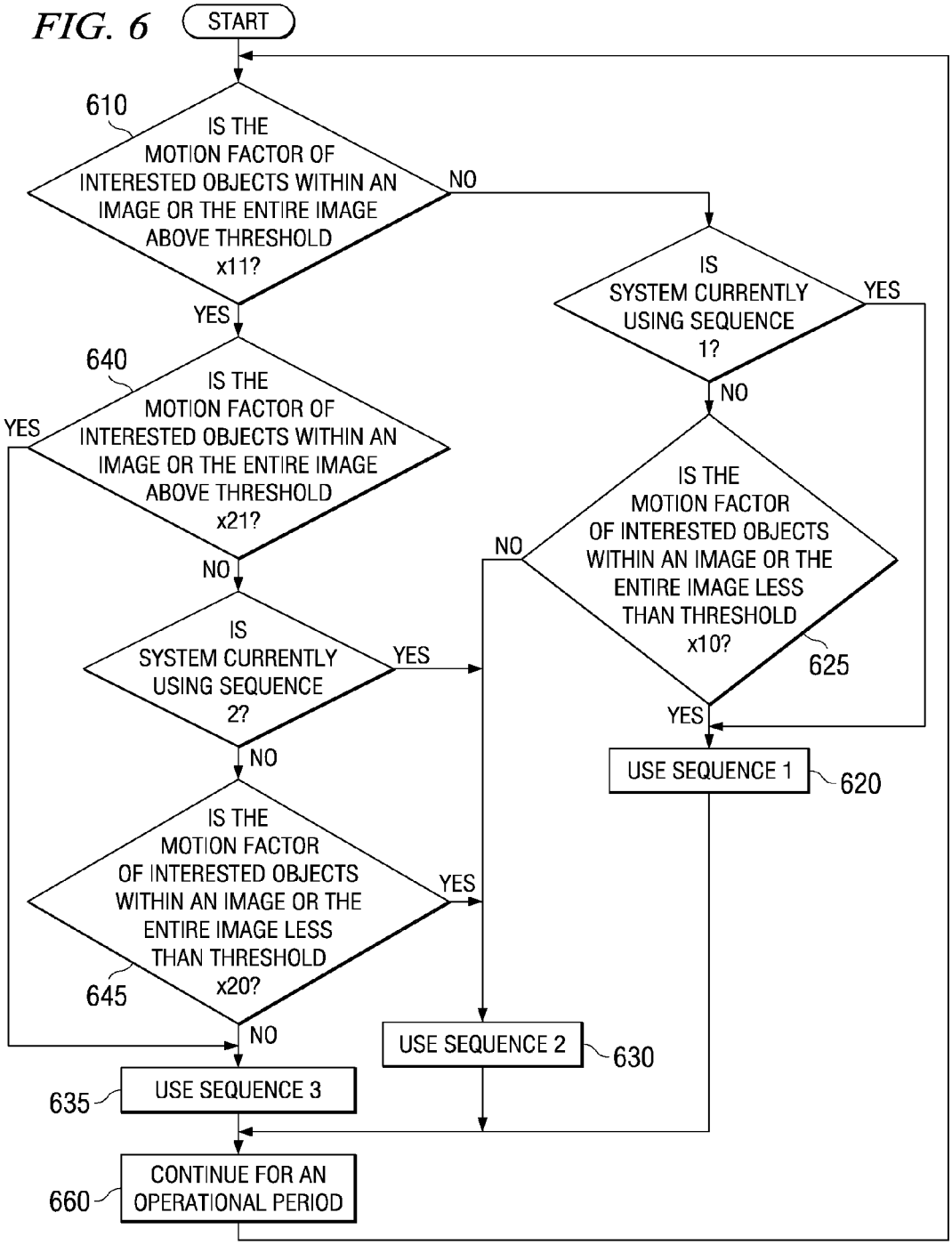
FIG. 6 is a schematic diagram illustrating a sequence selection technique using a decision matrix with hysteresis based on the motion in a scene.
Figure 6A:
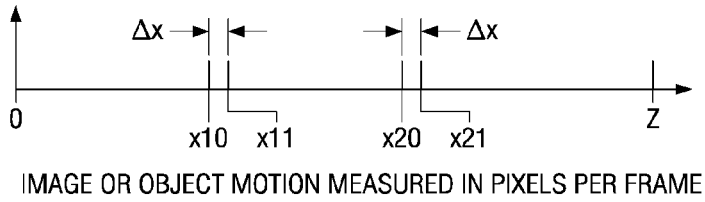
FIG. 6A is a chart illustrating exemplary hysteresis values for motion thresholds.

FIG. 6, in conjunction with FIG. 6A, provides an illustrative example of a hysteresis process used with a decision matrix for selecting between three available bit sequences based on image motion. As FIG. 6A shows, two standard thresholds (x11 and x21) may be used to select among three bit sequences, where 0<x11<x21<Z (with Z as the maximum possible level of image motion). In general, below threshold x11, sequence 1 would be used to display the image; above threshold x21, sequence 3 would be used to display the image; and for motion between thresholds x11 and x21, sequence 2 would be used to display the image. In the example of FIG. 6, sequence 1 would maximize brightness, sequence 3 would maximize bit depth, and sequence 2 would compromise between bit depth and brightness performance. These general rules may, however, be altered somewhat depending upon the hysteresis value of the system.

Each threshold value employs a hysteresis value of Δx. Thus, threshold x11 has an associated, paired threshold x10, which in the example of FIG. 6A is set at a motion level Δx below that of the primary threshold x11. Likewise, threshold x21 has an associated, paired threshold x20, set at a motion level Δx below that of the primary threshold x21. When such a hysteresis approach is used, the actual sequence used to display a particular scene depends not only on the detected level of image motion in comparison to the two primary thresholds (x11 and x21), but also on the sequence currently being used and the detected motion level in comparison to the paired hysteresis threshold. This may be clearly seen in the example of FIG. 6.

In FIG. 6, the image motion would be detected (typically based on an averaged histogram). If the motion is below threshold x11 (block 610) and the system is currently using sequence 1, then the system continues to use sequence 1 (block 620). If the motion is below threshold x11 (block 610) but the system is currently using sequence 2, then a second inquiry must take place to determine whether to continue using sequence 2 or to switch to sequence 1. This determination would be based on the hysteresis value. In this case, if the motion level is below hysteresis threshold x10 (block 625), then the system would switch to sequence 1 (block 620). On the other hand, if the motion level is above hysteresis threshold x10 (block 625), then the system would continue to use sequence 2 (block 630) to display the image.

If the image motion level is above threshold x21 (block 640), then sequence 3 (block 635) would be used to display the image. However, if the motion is above threshold x11 (block 610) but below threshold x21 (block 640), then additional inquiries would be needed to determine the appropriate sequence to use. In such an instance, if the system is currently using sequence 2, then it would continue to use sequence 2 (block 630). Otherwise, the determination would depend upon the hysteresis value. If the motion is below the hysteresis threshold x20 (645), then the system would switch to sequence 2 (block 630). On the other hand, if the motion is above hysteresis threshold x20 (but below threshold x21), then the system would continue to use sequence 3 (635) to display the image. FIG. 6 illustrates an exemplary decision matrix with hysteresis, but it should be understood that it is not intended to be limiting. For example, the hysteresis thresholds could be located Δx above the corresponding primary thresholds. More than three sequences could be used, with additional thresholds, and Δx could be set to any useful level of hysteresis. The example of FIG. 6 is merely intended to assist in illustrating the basic elements of hysteresis in the context of a decision matrix based on the level of image motion.

As discussed above with the other embodiments, an operational period 660 is illustrated to provide a resting point of sorts after a sequence has been determined before the scene is tested again for the characteristics being monitored. This operational period 660 may or may need be desired according to other system design considerations. If the operational period is not used, the process would repeat back to the starting determination at block 610 essentially after the sequence is determined and applied by the bit sequence controller 14 at block 620, 630, and 635.

Figure 7:
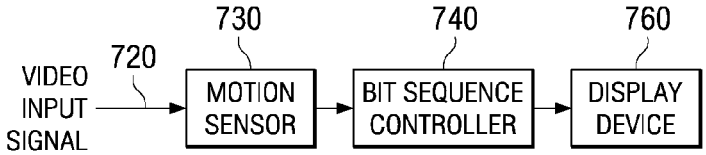
FIG. 7 is a block diagram of the elements of an exemplary device for implementing a dynamic bit sequence selection technique based on motion.

FIG. 7 generally illustrates exemplary elements for use with a display device utilizing a dynamic bit sequence selection technique based on motion. The input video signal 720 would be analyzed by the sensor 730 to determine the motion of the scene. The controller 740 would then compare the detected motion to one or more threshold values to determine which bit sequence (from a plurality of PWM bit sequences) to apply. The selected bit sequence would then control the display device 760 (for example, controlling the switching of the DMD micromirror elements in order to display the video image associated with the input video signal 720 on the display device 760). This process typically occurs in real-time, such that the input signal is continuously analyzed to dynamically determine and apply the appropriate bit sequence for displaying each frame of the input video signal 720.

Multiple image characteristics could be employed together to further optimize bit sequence selection. By way of example, bit sequence selection could be based on both the detected brightness level and amount of motion within a scene. Since the level and sort of motion that causes PWM artifacts is typically fairly infrequent, brightness determinations would often predominate. Thus, if motion is low (or in instances where motion is not sufficiently high to cause significant PWM artifacts), brightness switching, as described above, would generally be used. The switching process could be influenced, however, by the presence of sufficient motion in a scene. Thus, if significant motion is detected, it may be useful to switch to a bit sequence optimized to reduce PWM artifacts during the time of display of the motion. In other words, if there is significant motion in the scene, then a bit sequence that maximizes short bits may be selected, even if the scene is a bright one that would not typically require so many short bits. By using multiple image characteristics together to select the most appropriate bit sequence for a given situation, image display may be further refined and improved.

While the above descriptions specifically mention the use of fast clearing and global clearing to increase bit depth (by achieving short bits with bit display times less than the load time of the display device), the disclosed dynamic bit sequence selection techniques may be used in conjunction with any number/variety of PWM bit sequences. The dynamic bit sequence selection techniques are particularly versatile, since a variety of PWM sequences might be dynamically selected in order to optimize the performance of the device based on the detected image content. Likewise, a number of threshold values, based on various image characteristics, might be used to select the appropriate PWM bit sequence based upon the particular circumstances. Indeed, while the threshold values set forth in the examples above relate to scene brightness and/or motion, the threshold values used to select a bit sequence are not so limited, but may be based on other factors detectable within the image content. By modifying these criteria when designing a display device, such as a DMD, effective bit depth may be increased without a significant loss of brightness. Image display quality may thus be improved by selecting the appropriate bit sequence based on the specific image characteristics at a given time. And the disclosed dynamic bit sequence selection techniques are not limited to DMD technology, but may be used with any display technology with PWM.

Furthermore, it should be noted that the disclosed dynamic bit sequence selection techniques may be used in conjunction with other techniques designed to either increase bit depth or increase brightness. By way of illustrative example, the disclosed dynamic bit sequence selection techniques may be used in conjunction with Texas Instruments' Dynamic Black™ process. Dynamic Black is a process whereby the input signal is amplified to raise it above the level where short bits cannot be displayed (due to load time), while the light source for the DMD is dimmed (using an aperture or a shutter, for example) in order to provide for correct brightness levels. Using the disclosed dynamic bit sequence selection techniques in conjunction with the Dynamic Black process would allow for the brightness of the display device to be boosted while the bit depth is further improved. And when used in conjunction with such a Dynamic Black process, the same sensor might be used to detect the brightness level for both techniques.

While various embodiments in accordance with the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Field of the Invention," the claims should not be limited by the language chosen under this heading to describe the so-called field. Further, a description of a technology in the "Background of the Invention" is not to be construed as an admission that certain technology is prior art to any invention(s) in this disclosure. Neither is the "Brief Summary of the Invention" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A method for dynamically selecting between a plurality of pulse width modulation (PWM) bit sequences based on display image content in order to display image data from an input video signal upon a display device, comprising:

determining a level of brightness of a displayed image;

if the brightness level is less than a given threshold, selecting a bit sequence that uses short bits with display time periods less than a load time; and if the brightness level is greater than the given threshold, selecting a bit sequence that avoids using short bits with display time periods less than the load time.

2. The method of claim 1, wherein the input video signal is analyzed by a sensor to determine the brightness level.

3. The method of claim 2, wherein a controller compares the determined brightness level to one or more threshold values or a decision matrix to determine which bit sequence to select.

4. The method of claim 3, further comprising using the selected bit sequence to control switch settings of an array of light modulating elements of a spatial light modulator.

5. The method of claim 4, wherein the selected bit sequence controls the switching of an array of micromirror elements in order to display the video image associated with the input video signal.

6. The method of claim 5, wherein the input signal is continuously analyzed to dynamically determine and apply selected bit sequences for respectively displaying successive frames of the video image.

7. The method of claim 6, wherein a selected bit sequence is applied for a given operational time period before a different selected bit sequence is applied.

8. The method of claim 6, wherein the determining and selecting steps are implemented in computer hardware, software or firmware operating in the bit sequence controller, operating in communication with the sensor.

9. The method of claim 8, wherein the brightness is determined by analyzing a total average power of the input video signal per frame.

10. The method of claim 9, wherein the brightness is determined based on an average applied across multiple frames.

11. The method of claim 8, wherein the brightness is determined using a histogram.

12. The method of claim 11, wherein a continuum of brightness levels is divided into discrete brightness level intervals; for a given frame or image, a number of pixels is determined for each brightness level; and an average brightness of a frame is determined from the determined number of pixels for each brightness level.

13. The method of claim 8, wherein the selected bit sequence that uses short bits is a PWM bit sequence that uses global or fast clears that allow for short bits whose bit display time periods less than the load time result in deadtime.

14. The method of claim 1, wherein the given threshold is a first threshold; if the brightness level is less than the given first threshold, a bit sequence is selected that uses a number of short bits which maximizes an available bit depth; wherein, if the brightness level is greater than the given first threshold and also greater than a given second threshold, a bit sequence is selected that uses no short bits; and if the brightness level is greater than the given first threshold but less than the given second threshold, a bit sequence is selected that uses a number of short bits less that the number of short bits which maximizes the available bit depth.

15. The method of claim 1, further comprising using the selected bit sequence to control switch settings of an array of light modulating elements of a spatial light modulator.

16. The method of claim 15, wherein the selected bit sequence controls the switching of an array of micromirror elements in order to display the video image associated with the input video signal.

17. The method of claim 1, wherein the input signal is continuously analyzed to dynamically determine and apply selected bit sequences for respectively displaying successive frames of the video image.

18. The method of claim 1, wherein a selected bit sequence is applied for a given operational time period before a different selected bit sequence is applied.

19. The method of claim 1, wherein the determining and selecting steps are implemented in computer hardware, software or firmware operating in the bit sequence controller, operating in communication with the sensor.

20. The method of claim 1, wherein the selected bit sequence includes global or fast clears that allow for short bits whose bit display time periods less than the load time result in deadtime.

21. A device for dynamically selecting between a plurality of pulse width modulation (PWM) bit sequences based on display image content in order to display image data from an input video signal, comprising:

a sensor operable to detect a level of brightness of a displayed image;

a controller operable, based on the detected brightness level, to:

if the brightness level is less than a given threshold, select a bit sequence that uses short bits with display time periods less than a load time; and if the brightness level is greater than the given threshold, selecting a bit sequence that avoids using short bits with display time periods less than the load time; and a display device operable to display images based on the input video signal using the selected bit sequence in order to display the video image associated with the input video signal.

22. The device of claim 21, wherein the display device comprises a spatial light modulator including an array of light modulating elements having switch settings controlled using the selected bit sequence.

23. The device of claim 22, wherein the light modulating elements are micromirror elements.

* * * * *